US008602317B2

(12) United States Patent
Bösterling et al.

(10) Patent No.: US 8,602,317 B2
(45) Date of Patent: Dec. 10, 2013

(54) SUPPORT FOR A SYSTEM FOR FASTENING A RAIL AND A SYSTEM FOR FASTENING A RAIL

(75) Inventors: Winfried Bösterling, Neuenrade (DE); André Hunold, Iserlohn (DE)

(73) Assignee: Vossloh-Werke GmbH, Werdohl (DE)

( * ) Notice: Subject to any disclaimer, the term of this patent is extended or adjusted under 35 U.S.C. 154(b) by 319 days.

(21) Appl. No.: 12/810,424

(22) PCT Filed: Jan. 8, 2009

(86) PCT No.: PCT/EP2009/050171

§ 371 (c)(1),
(2), (4) Date: Sep. 29, 2010

(87) PCT Pub. No.: WO2009/087191

PCT Pub. Date: Jul. 16, 2009

(65) Prior Publication Data

US 2011/0042475 A1 Feb. 24, 2011

(30) Foreign Application Priority Data

Jan. 10, 2008 (DE) ..... 10 2008 003 744

(51) Int. Cl.
*E01B 9/00* (2006.01)

(52) U.S. Cl.
USPC ..... 238/312

(58) Field of Classification Search
USPC ..... 238/312, 315, 316, 321, 338, 341, 342, 238/346, 349, 379
See application file for complete search history.

(56) References Cited

U.S. PATENT DOCUMENTS

| | | | | | |
|---|---|---|---|---|---|
| 3,858,804 | A | * | 1/1975 | Hixson | 238/264 |
| 4,326,670 | A | * | 4/1982 | Sherrick et al. | 238/341 |
| 4,967,954 | A | * | 11/1990 | von Lange | 238/310 |
| 2010/0243752 | A1 | | 9/2010 | Bosterling et al. | |

FOREIGN PATENT DOCUMENTS

| | | | |
|---|---|---|---|
| DE | 2600416 | B1 | 3/1977 |
| JP | 353104 | | 6/1960 |
| JP | 4726903 | | 11/1972 |
| WO | 03046284 | A1 | 6/2003 |
| WO | 2007082553 | A1 | 7/2007 |
| WO | 2009037204 | A1 | 3/2009 |

* cited by examiner

*Primary Examiner* — R. J. McCarry, Jr.
(74) *Attorney, Agent, or Firm* — The Webb Law Firm

(57) ABSTRACT

The invention relates to a support for a system for fastening a rail on a substrate, having an angle bracket, which has a base section with a contact surface associated with the respective substrate, also having a supporting section, standing on the base section, which on its free front side associated with the rail to be fastened has a bearing surface, and also having a through hole formed in the base section for inserting a fastening element intended for fixing the angle bracket on the substrate. With such a support reliable support of the rail in service, also with greater tolerance for positioning the individual components, according to the invention is ensured by the fact that the through hole at least in a direction aligned parallel to the contact surface has an over-measure in relation to the circumference of the part, in the assembled condition sitting in the through hole, of the fastening element and by the fact that an additional locking piece, cooperating with the fastening element for fixing the angle bracket in a particular relative position obtained by a relative movement of fastening element and angle bracket, is also provided.

17 Claims, 2 Drawing Sheets

SUPPORT FOR A SYSTEM FOR FASTENING A RAIL AND A SYSTEM FOR FASTENING A RAIL

BACKGROUND OF THE INVENTION

1. Field of the Invention

The invention relates to a support for a system for fastening a rail on a substrate with an angle bracket, which has a base section with a contact surface associated with the respective substrate, with a supporting section standing on the base section, which on its free front side, associated with the rail to be fastened, has a bearing surface, and also having a through hole formed in the base section for inserting a fastening element intended for fixing the angle bracket on the substrate.

Furthermore the invention relates to a system for fastening a rail on a substrate with a guide plate for lateral support of the rail to be fastened, with a spring element, which is supported on the guide plate and having at least one spring arm, which is provided to exert a flexible retaining force onto the foot of the rail, comprising means for tightening the spring element as well as a support, which is intended to be firmly connected to the substrate and in the assembled position to support the guide plate against transverse forces arising when the rail is driven over.

2. Description of the Related Art

A support and a system of this type are known for example from the German Patent DE-AS 26 00 416.

The known systems in particular serve for fastening rails on a rigid level substrate, wherein no recesses are formed or no elevations are embodied, on which the rail could be supported against the transverse forces arising at the corresponding fastening point when the rail is driven over.

Rigid substrates, on which systems of the inventive type are installed, in practice are also designated "rigid track bed". In contrast to a track structure built on loose ballast they do not possess any intrinsic flexibility. Typically rigid track beds are formed from concrete slabs, on which sleepers likewise cast from concrete are laid, which in turn support the rails.

The rails are usually laterally supported on such a rigid substrate by supporting devices, which are positioned on both sides of the rail foot between the rail foot and possibly a shoulder arranged laterally at a distance from the rail foot. This shoulder is usually provided for this purpose on the respective rigid substrate in the form of a support shoulder or the like.

Thus the concrete sleepers typically used for fastening rails on a rigid track bed usually have lateral shoulders, against which the guide plates provided for lateral guidance of the respective rail are supported. These guide plates are fixed either directly on the rigid substrate or the individual sleeper by means of suitable fastening devices, usually bolts. A corresponding system is known in practice for example under the reference "300 system".

Usually the fastening devices are also used for clamping a spring element, which exerts a retaining force, directed at the rigid substrate, onto the foot of the rail to be fastened. Dependent on the nature of the substrate and the fastening devices used, additional mountings and fastenings are needed for correct alignment and support of the rails. On track bed surfaces, which are level, that is to say where there are no shoulders for lateral support of the guide plates, fastening systems of the type described above cannot be used. Instead supports, as described in DE-AS 26 00 416 already mentioned, are needed there.

The main requirement for the correct functioning of a fastening system of the type detailed above is that the rail is laterally supported in a manner, which is substantially free from play. Relative movements between the rail and the substrate, on which it stands as the case may be, would otherwise cause substantial abrasive wear in the supporting section of the rail foot.

In order to meet this requirement the support used in the known system comprises an angle bracket, which is fixed on the respective substrate by means of a fastening bolt, inserted through the opening formed in its base section. The bearing surface, associated with the guide plate, of the angle bracket is therefore inclined.

On the inclined bearing surface of the angle bracket the guide plate of the known fastening system lies in close contact with a correspondingly inclined supporting surface, whereby an insulating layer may be provided between the bearing surface and the supporting surface, in order to ensure electrical insulation between the angle bracket and the guide plate. At the same time the guide plate, with its bearing surface associated with the rail possibly likewise laterally lies in contact with the rail foot via a correspondingly insulating intermediate layer.

The guide plate is likewise fastened on the respective substrate in the known system by a bolt inserted in a corresponding through hole, which in the case of fastening on a rigid track bed is screwed for example into a dowel set into the substrate. In this case not only the guide plate is held, but also the tension clamp is tightened by means of a nut screwed onto the bolts, which exerts the necessary retaining force onto the ribbed plate.

A problem with fastening rails in the way described above, known from DE-AS 26 00 416, is that it does not allow precise alignment of the individual parts constituting the fastening. This relates in particular to the relative position of guide plate and angle bracket.

Practical experience has shown that such precise positioning, under the conditions prevailing in practice, frequently cannot be guaranteed with the necessary reliability. This applies in particular if a large number of fastenings of this type are to be assembled in a mass operation so as to be able to save time when laying long sections of track.

SUMMARY OF THE INVENTION

With this background the object of the invention was to create a support and a system for fastening rails, wherein reliable support of the rail is also ensured in service with greater tolerance for positioning the individual components of such a fastening.

An inventive support, just as the support known from the prior art, comprises an angle bracket, whose contact surface and bearing surface are arranged at an angle to one another, a through hole likewise being formed in the base section, in which the respective fastening element belonging to the support is also inserted.

According to the invention this through hole is now formed so that the fastening element, in the assembly position, loosely sits in at least one direction in the through hole, thus the angle bracket can also still be moved in the direction concerned, with the fastening element sitting in the respective substrate. For this purpose the through hole, at least in a direction aligned parallel to the bearing surface has an overmeasure in relation to the circumference of the fastening element, exceeding the usual size for simple insertion of the fastening element. This amounts to at least 1.5-2 times the diameter of the fastening element.

Here a "through hole" is understood to mean any openings or recesses, which are designed so that the respective fastening element can be inserted therein as far as the particular substrate. Accordingly the term "through hole" in the sense of the invention also includes for example recesses, which are formed in the base section of the angle bracket and are laterally bordered by a protruding area of the base section in each case, so that it is possible to push the angle bracket as a kind of shoe from the lateral direction onto a correspondingly pre-assembled fastening element.

It is only important in this case that the "through hole" concerned is formed at least in one direction so that in at least one direction of movement, aligned parallel to the plane of the bearing surface of the fastening element, there is no positive connection between the edge of the through hole and the fastening element in each case. This inventive nature of the through hole in the angle bracket makes it possible to pre-assemble the angle bracket and the fastening element as well as the other components of the respective fastening system and thereafter only to move the angle bracket to its normal position, in which the supporting angle and the element, possibly supported thereby, lie as far as possible without play against the foot of the rail to be fastened. Subsequently the situation of the angle bracket, taken up in each case, can be fixed in position by final adjustment of the fastening element of the support, so that reliable lateral support of the rail is ensured in service.

For this purpose the inventive support comprises an additional locking piece cooperating with the fastening element, by means of which the angle bracket can be fixed in a particular relative position, obtained by a relative movement, of fastening element and angle bracket.

Accordingly an inventive fastening system is characterized in that the support proposed therein is embodied in the inventive way.

In principle it is conceivable to design the locking piece so that with its help the relative position of fastening element and angle bracket, obtained after the angle bracket has been aligned, can be defined by non-positive connection, in particular friction connection.

With regard to operational reliability and simplicity of assembly however, it has been shown to be particularly advantageous if the respective situation of the angle bracket, relative to the fastening device, is fixed by means of positive connection. For this purpose the locking piece can have at least one profile element, which is intended to make positive connection with a correspondingly shaped profile element of the angle bracket.

In order at the same time to permit as wide tolerance as possible for positioning the angle bracket in relation to the fastening element, the locking piece can comprise a plurality of such profile elements. Alternatively or in addition, for the same purpose it may be advantageous if a corresponding profile element is also embodied on the angle bracket and the number of profile elements of the locking piece is less than the number of corresponding profile elements of the angle bracket. In this way the angle bracket can be moved for example over a distance, which is more than the length of the locking piece, on which its profile elements are distributed and for finally fixing the position of the angle bracket a reliable positive connection nevertheless via the locking piece is made between the angle bracket and the fastening element in all directions of movement.

It is also conceivable however that initially a profile element necessary for positive connection is embodied only on the locking piece and this profile element, when force is applied accordingly via the fastening element, digs into the surface of the supporting element in order thus to reproduce the corresponding profile element, necessary for positive connection of the angle bracket, in the surface concerned. This is possible in particular if the angle bracket is made of plastic and the locking piece from a material with a higher strength, steel for example.

A particularly reliable positive connection of the angle bracket can be achieved if the profile elements of angle bracket and locking piece extend transversely to the direction, in which the angle bracket in the pre-assembled condition can be moved in relation to the fastening element due to the inventive nature of the through hole.

A first possibility regarding the arrangement of the profile elements necessary for positive connection between angle bracket and locking piece consists in the fact that the profile element concerned is embodied on the lower surface of the locking piece, which in the assembled condition is associated with the free upper side of the base section of the angle bracket. The corresponding profile elements can then be embodied on the upper side of the base section of the angle bracket.

Alternatively or in addition the locking piece can also have a side surface, on which the respective profile element needed to make the positive connection is embodied. The angle bracket likewise can then have a laterally aligned surface, on which the respective corresponding profile element, cooperating with the profile element of the locking piece, is embodied. A positive connection, also withstanding very high loads, between the locking piece and the supporting element in this case can be ensured if the locking piece has a second side surface, which is opposite the first side surface and on which a profile element is likewise embodied, and if the angle bracket has a second side surface, which is arranged at a distance from the first side surface and is provided with profile elements, so that the locking piece can be inserted between the two side surfaces of the angle bracket and, when the locking piece is seated between the two side surfaces, if a positive connection is made between the profile elements, corresponding to each other, of the side surfaces associated with one another.

The latter arrangement has been shown to be particularly practical if the angle bracket has at least two reinforcement ribs, which extend between the supporting section and the base section and between these laterally border an area, in which the locking piece is positively held at least in sections when the support is finally assembled.

The connection between locking piece and fastening element can be made particularly simply if the locking piece has a through hole for the fastening element, in which the fastening element, in the assembled condition, sits with marginal play.

The alignment and fixing of the angle bracket, correctly positioned in relation to the fastening element with the help of the locking piece, can be assisted if markings are provided on the locking piece and/or the angle bracket, from which the particular relative position of angle bracket and locking piece and therefore generally of angle bracket and fastening element can be read.

In practice the positive connection, by means of the locking piece, between fastening element and angle bracket can be made for example if the profile elements of the locking piece and angle bracket cooperate as a kind of a snap-lock.

An embodiment of the invention permitting particularly simple and at the same time reliable operation in service proposes that the inventive over-measure of the through hole in the angle bracket is only provided in the direction of movement necessary for the particular application. For this purpose the through hole may be formed as a slotted hole. In order to cover the most frequent case in practice here of post-adjustment in a direction aligned transversely to the rail alignment, the longitudinal axis of the slotted hole may be aligned substantially perpendicularly to the bearing surface of the supporting section.

BRIEF DESCRIPTION OF THE DRAWINGS

The invention is described below in more detail on the basis of a drawing illustrating an exemplary embodiment, wherein.

DETAILED DESCRIPTION OF THE PREFERRED EMBODIMENTS

Figure 1:
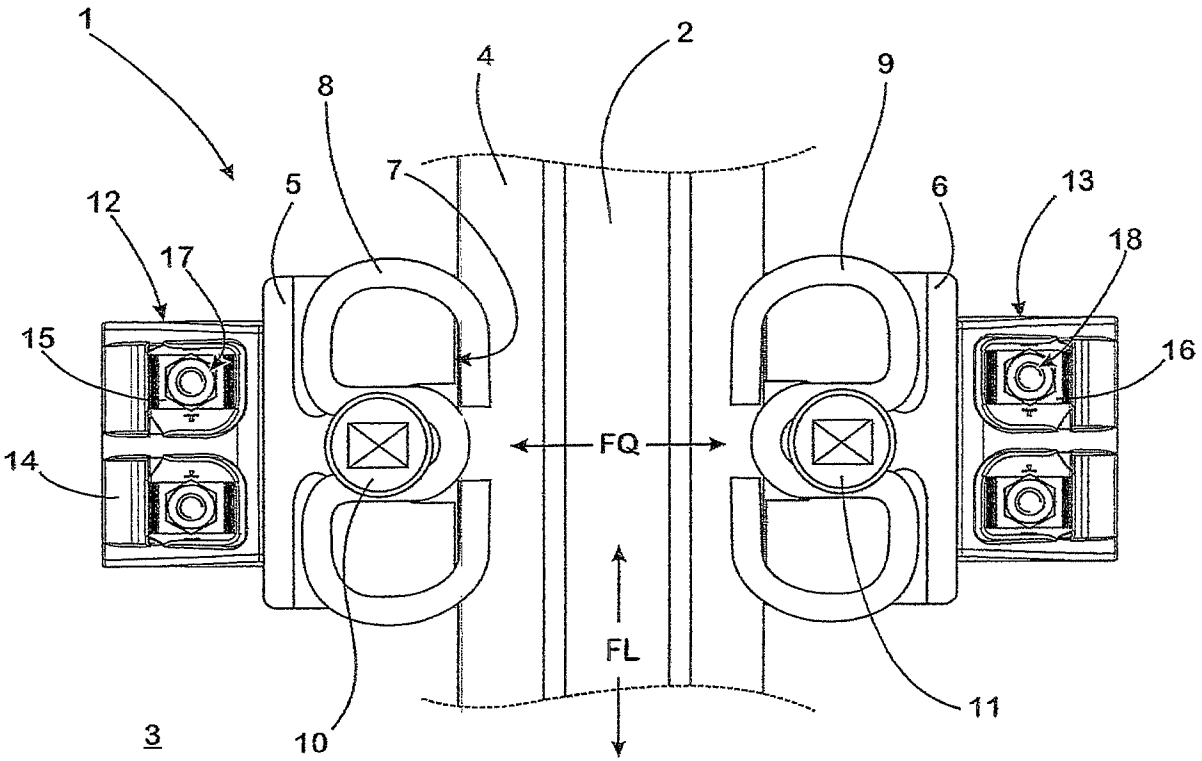
FIG. 1 shows a system for fastening a rail in a view from above.

The system 1 for fastening a rail 2 on a rigid substrate 3, for example formed by a concrete slab or a concrete sleeper comprises a flexible intermediate plate (not shown here), which directly lies on the continuous level surface of the rigid substrate 3.

On the intermediate plate lies a base plate made from steel (here likewise not shown) which covers the intermediate plate and which in practical use distributes onto the intermediate plate the loads arising when the rail 2 is driven over by a rail-mounted vehicle (not shown here) acting on the base plate via the rail 2 in the direction of gravity.

A further intermediate layer (also not shown here) covers the base plate. Its width corresponds at maximum to the width of the foot 4 of the rail 2, which with its lower surface stands on the intermediate layer.

In order to adjust any necessary inclination of the rail 2 in relation to the level surface of the rigid substrate 3, the base plate can have a wedge-shaped cross-section, wherein its upper surface associated with the rail foot 4 forms an acute angle with the lower side, associated with the intermediate plate, of the base plate.

For lateral support of the rail 2 against the transverse forces FQ arising when the rail is driven over, a guide plate 5, 6 is arranged on both sides of the rail foot 4 in each case. The guide plates 5, 6 respectively have a supporting surface lying against the rail foot 4 and via corresponding supporting sections stand on the level surface of the rigid substrate 3.

On its lower section, adjacent to the surface of the rigid substrate 3, a cam-like projection (not shown here) which protrudes into a correspondingly formed recess (likewise not shown here) of the flexible intermediate plate and in this case engages under the base plate, can be formed on the supporting surface of the guide plates 5, 6. In this way the respective guide plate 5, 6 is positively held in the vertical direction V, so that the possibility of the guide plates 5, 6 lifting off from the substrate 3 is safely ruled out, even though longitudinal forces FL or transverse forces FQ, unfavourable in this regard, arise.

On their free upper sides the guide plates 5, 6 in the way known per se have shaped profile elements, which form guides for in each case a co-shaped tension clamp 8, 9 serving as spring element for clamping the rail 2 on the rigid substrate 4. For tightening the tension clamps 8, 9 means are provided in the form of bolts 10, 11, which are screwed into a dowel (not shown here) set into the rigid substrate 3 in each case. The bolts 10, 11 via their bolt head load the central section of the tension clamps 8, 9 in the way known per se, so that the tension clamps 8, 9 via the free ends of their arms, lying on the upper side of the rail foot 4, exert the necessary retaining spring force onto the rail foot 4.

Lateral support of the guide plates 5, 6 is provided by a support 12, 13 in each case.

Supports 12, 13 respectively comprise an angle bracket 14, two locking pieces 15, 16 as well as two fastening devices 17, 18. The fastening devices 17, 18 are formed here in each case by a threaded bolt 19 and a nut 20 screwed onto the bolt. If required further devices, such as for example spring washers or flat washers can be provided in order to distribute the retaining force FH in each case required by the fastening device 17, 18 onto the locking pieces 15, 16.

The angle brackets 14 of the supports 12, 13 in each case can be integrally made of fibre-reinforced plastic. In exactly the same way they can also for example be made from steel material in a forging process.

Figure 4:
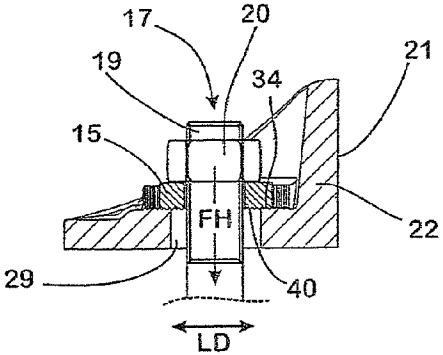
FIG. 4 shows the support used by the system in FIG. 1 with the components shown in FIGS. 2 and 3 in longitudinal profile.
Figure 3:
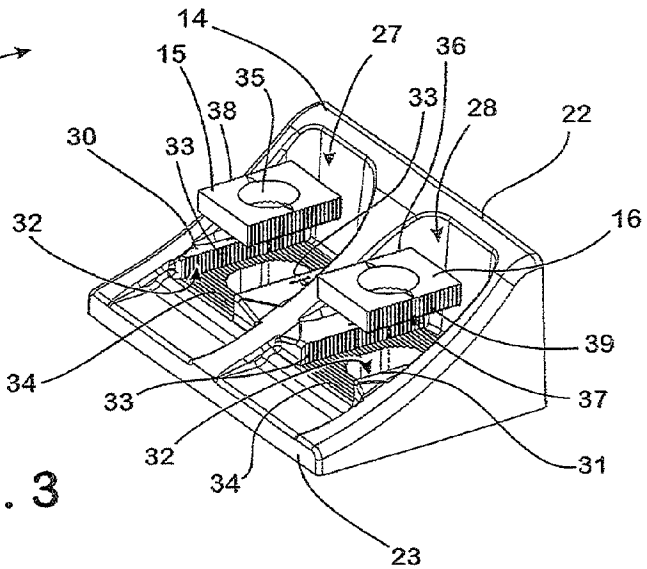
FIG. 3 shows the components shown in FIG. 2 in exploded illustration.
Figure 2:
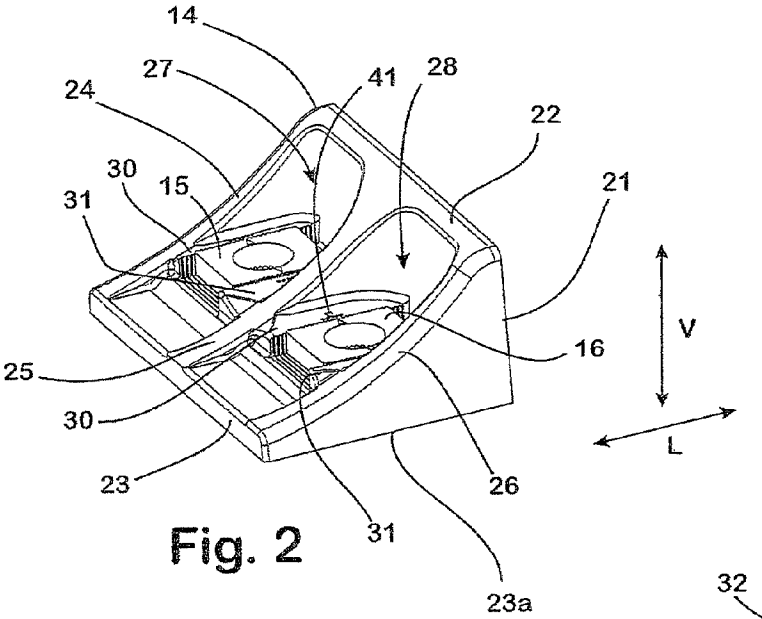
FIG. 2 shows an angle bracket and two locking pieces of a support used by the system illustrated in FIG. 1 in the assembly position in a perspective view.

As illustrated in FIGS. 2-4 with reference to the support 12, the supports 12, 13 in each case have a level bearing surface 21 lying on the guide plate 5, 6 associated therewith in each case. The supporting surface 21 is embodied on the free face of a supporting section 22 of the angle brackets 18, 19, which is mounted at right-angles to a base section 23, with its contact surface 23*a* lying on the upper side of the rigid substrate 3, of the angle bracket 14 on its front side, associated with the respective guide plate 5, 6.

Opposite the base section 23 the support section 22 is supported by means of three reinforcement sections 24, 25, 26 emanating substantially at right-angles, triangular in shape when viewed from the side, whose free upper side runs diagonally outwards starting from the upper side of the supporting section 22. One of the reinforcement sections 24, 25, 26 is embodied on one of the outer edges and one is embodied in the centre of the angle brackets 14 in each case.

In the vicinity of the free areas 27, 28 remaining between the reinforcement sections 24, 25, 26 laterally bordered by the reinforcement sections 24, 25, 26 a through hole 29, designed as slotted hole in each case, is formed in the base section 23 of the angle brackets 14. The longitudinal axis LD of the through holes 29 in this case is aligned substantially at right-angles to the bearing surface 21 of the supporting section 22. The length, measured in the longitudinal direction L of the through holes 29, corresponds to approximately double the diameter of the threaded bolts 19 of the fastening elements 17, 18.

In each case a shoulder 30, 31 protruding into the respective areas 27, 28, with the side surfaces 32 aligned parallel to one another, is embodied in the areas 27, 28 at the foot of the reinforcement sections 24, 25, 26.

Profile elements 33 arranged close to each other are formed at regular intervals on the respective side surface 32 of the shoulders 30, 31 in each case. The profile elements 33 are embodied as kind of snap projections and aligned perpendicularly to the upper side of the base section 23 as well as substantially parallel to the bearing surface 21 of the supporting section 22. In the vicinity of the surface section of the upper side laterally bordered by the side surfaces 32 of the shoulders 30, 31, profile elements 34 as kind of snap projections, which extend between the shoulders 30, 31 and accordingly transversely to the longitudinal direction L of the through holes 27, are likewise formed on the base section 23. Each profile element 34 in this case changes into a corresponding profile element 33 of the shoulders 30, 31.

The locking pieces 15, 16 are in the shape of a cuboid and in each case have a through hole 35 leading from their upper side to their lower side associated with the upper side of the base section 23, whose diameter is adapted to the diameter of the threaded bolts 19 of the fastening elements 17, 18 so that they can be placed onto the bolts with slight play. The width of the locking pieces 15, 16 is adapted to the clear width between the shoulders 30, 31 in each case.

The locking pieces 15, 16 on their side surfaces 36, 37 associated with the shoulders 30, 31 in each case have profile elements 38, 39 embodied as kind of snap projections, which with regard to their shape and arrangement are adapted to the shape and arrangement of the profile elements 33 of the shoulders 30, 31. In exactly the same way the locking pieces on their lower surface in each case have profile elements 40, which with regard to their shape and arrangement are adapted to the shape and arrangement of the profile elements 34 embodied on the upper side of the base section 23.

When the fastening system 1 is installed firstly the guide plates 5, 6 and the tension clamps 8, 9, are pre-assembled so that the guide plates 5, 6 are aligned in the correct position and the tension clamps 8, 9 are in a retracted position, whereby their spring arms do not reach into the area, wherein the rail 4 is subsequently seated. The threaded bolts 19 of the fastening elements 17, 18 of the supports 12, 13 are then screwed into dowels (not shown here) set previously for this purpose into the substrate and the respective angle bracket 14 is placed on the substrate 3 so that the threaded bolts 19 are inserted in the through hole 29, associated therewith in each case, of the respective angle bracket 19.

Subsequently the angle brackets 14 are moved in the longitudinal direction L of the through holes 29, until they lie closely on the guide plate 5, 6 associated therewith in each case. Thereupon the locking pieces 15, 16 are placed on the threaded bolts 19 and pushed into the free area between the respective shoulders 30, 31, so that their profile elements 39, 40 cooperate positively with the profile elements 33 of the shoulders 30, 31 and with the profile elements 34 provided on the upper side of the basic shoulder 23. Henceforth the relative situation of the angle brackets 14 to the fastening elements 17, 18 associated therewith is already assured by means of the locking pieces 15, 16, in the longitudinal direction L, that is to say in the direction aligned transversely to the longitudinal extension of the rail, by positive connection. Markings 41 provided on the upper side of the shoulders 30, 31 and the locking pieces 15, 16 indicate whether the angle brackets 14 have been moved within a permissible range of tolerance. Thereupon the nuts 20 are screwed onto the threaded bolts 19 in order to prevent the angle brackets 14 from lifting off by frictional force.

The invention claimed is:

1. A support for a system for fastening a rail on a substrate, the support comprising:

an angle bracket having a base section with a contact surface adapted for contacting the substrate;

a supporting section extending from the base section and having a bearing surface at a free front side which bearing surface is adapted for laterally supporting the system for fastening the rail on the substrate in a direction transverse to a longitudinal extent of the rail;

a through hole formed in the base section for inserting a fastening element for fixing the angle bracket to the substrate, wherein the through hole at least in a direction aligned parallel to the contact surface is larger in relation to the circumference of a section of the fastening element that, in the assembled condition, passes through the through hole wherein a locking piece, cooperating with the fastening element, is provided for fixing the angle bracket in a particular relative position with respect to the fastening element, obtained by relative movement of fastening element and the angle bracket.

2. The support according to claim 1, wherein the through hole is formed as slotted hole.

3. The support according to claim 2, wherein the longitudinal axis of the through hole is aligned perpendicularly to the supporting surface of the supporting section.

4. The support according to claim 1, wherein the locking piece has at least one profile element, which makes a positive connection to a correspondingly formed profile element of the angle bracket.

5. The support according to claim 4, wherein the locking piece has a plurality of profile elements adapted for engaging the angle bracket.

6. The support according to claim 5, wherein a number of profile elements on the locking piece is less than a number of corresponding profile elements on the angle bracket which engage the profile elements on the locking piece.

7. The support according to claim 4, wherein the locking piece has a lower side adapted for engaging an upper side of the base section and wherein the profile element is embodied on the lower side.

8. The support according to claim 4, wherein the locking piece has a first side surface having a second profile element and wherein the angle bracket has a surface laterally aligned with the first side surface of the profile element, wherein the surface of the angle bracket has a corresponding second profile element adapted for engaging the second profile elements of the locking piece.

9. The support according to claim 8, wherein the locking piece has a second side surface, which lies opposite the first side surface and on which a profile element is likewise embodied, and the angle bracket has a second side surface, which is arranged at a distance from the first side surface and is equipped with profile elements, so that the locking piece can be inserted between the two side surfaces of the angle bracket and with the locking piece sitting between the two side surfaces, a positive connection is made between the profile elements of the side surfaces associated with one another.

10. The support according to claim 4, wherein the profile elements of locking piece and angle bracket form a snap-lock.

11. The support according to claim 1, wherein the angle bracket has at least two reinforcement ribs, which extend between the supporting section and the base section and between one another laterally border an area, in which the locking piece, when the support is finally assembled, is held positively at least in sections.

12. The support according to claim 1, wherein the locking piece has a through hole for the fastening part.

13. The support according to claim 1, wherein the locking piece is in the shape of a cuboid.

14. The support according to claim 1, wherein markings are provided on the locking piece and/or the angle bracket, from which the particular relative position of angle bracket and locking piece can be read.

15. The support according to claim 1, wherein the fastening part in each case is formed by a threaded bolt and a nut, to be screwed onto the bolt, which in the finally assembled condition acts on the locking piece.

16. The support according to claim 1, wherein the fastening part is formed by a bolt, which in the finally assembled condition, with its bolt head, acts on the locking piece.

17. A system for fastening a rail on a substrate comprising a guide plate for lateral support of the rail to be fastened;

a spring element, which is supported on the guide plate and having at least one spring arm, which is intended to exert a flexible retention force onto the foot of the rail; and means to clamp the spring element as well as a support, which is intended to be firmly connected to the substrate and in the assembled position to laterally support the guide plate against transverse forces arising when the rail is driven over, wherein the support is embodied according to claim 1.

* * * * *

UNITED STATES PATENT AND TRADEMARK OFFICE

CERTIFICATE OF CORRECTION

PATENT NO. : 8,602,317 B2
APPLICATION NO. : 12/810424
DATED : December 10, 2013
INVENTOR(S) : Bösterling et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 398 days.

Signed and Sealed this
Twenty-second Day of September, 2015

Michelle K. Lee

Michelle K. Lee
*Director of the United States Patent and Trademark Office*